US009255689B2

(12) United States Patent
Wang He

(10) Patent No.: US 9,255,689 B2
(45) Date of Patent: Feb. 9, 2016

(54) OPTICAL LENS AND LIGHT SOURCE MODULE HAVING THE SAME

(71) Applicant: HON HAI PRECISION INDUSTRY CO., LTD., New Taipei (TW)

(72) Inventor: Li-Ying Wang He, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 74 days.

(21) Appl. No.: 14/060,627

(22) Filed: Oct. 23, 2013

(65) Prior Publication Data

US 2015/0078008 A1 Mar. 19, 2015

(30) Foreign Application Priority Data

Sep. 18, 2013 (TW) ..... 102134009

(51) Int. Cl.
*F21V 5/00* (2015.01)
*F21V 5/04* (2006.01)
*F21Y 101/02* (2006.01)

(52) U.S. Cl.
CPC ..... *F21V 5/045* (2013.01); *F21V 5/005* (2013.01); *F21Y 2101/02* (2013.01)

(58) Field of Classification Search
CPC ..... F21V 5/046; F21V 5/045
USPC ..... 362/308, 309, 310, 311.02, 337
See application file for complete search history.

(56) References Cited

U.S. PATENT DOCUMENTS

| | | | | |
|---|---|---|---|---|
| 7,021,805 | B2 * | 4/2006 | Amano et al. | 362/518 |
| 8,167,462 | B2 * | 5/2012 | Kim et al. | 362/311.02 |
| 8,251,547 | B2 * | 8/2012 | Yamaguchi | 362/311.02 |
| 8,330,342 | B2 * | 12/2012 | Bhairi | 313/116 |
| 8,833,979 | B2 * | 9/2014 | Wang et al. | 362/311.01 |
| 8,926,114 | B2 * | 1/2015 | Park et al. | 362/97.3 |
| 8,979,325 | B2 * | 3/2015 | Ariyoshi | 362/311.02 |
| 2012/0300493 | A1 * | 11/2012 | Chang et al. | 362/602 |

* cited by examiner

*Primary Examiner* — Peggy Neils
(74) *Attorney, Agent, or Firm* — Novak Druce Connolly Bove + Quigg LLP

(57) ABSTRACT

A light source module includes a light source and an optical lens facing the light source. The optical lens includes a light incident face facing the light source, a light emitting face opposite to the light incident face, and a connecting face connecting the light incident face and the light emitting face. The connecting face is planar. The light emitting face includes a lateral face extending upwardly from an outer periphery of the connecting face and a top face located above the light incident face. The optical lens further includes a plurality of protrusions protruding outwardly from the light emitting face, and a plurality of grooves defining in the connecting face. The protrusions are formed on the lateral face and located adjacent to the connecting face, and the grooves are located adjacent to the lateral face.

20 Claims, 4 Drawing Sheets

OPTICAL LENS AND LIGHT SOURCE MODULE HAVING THE SAME

BACKGROUND

1. Technical Field

The disclosure generally relates to optical lenses, and particularly relates to an optical lens to increase an illuminating angle of a light source and a light source module having the optical lens.

2. Description of Related Art

In recent years, due to excellent light quality and high luminous efficiency, light emitting diodes (LEDs) have increasingly been used as substitutes for incandescent bulbs, compact fluorescent lamps and fluorescent tubes as light sources of illumination devices.

Generally, light intensity of a light emitting diode gradually decreases from a middle portion to lateral sides thereof. Such a feature makes the LED unsuitable for functioning as a light source which needs a wide illumination, for example, a light source for a direct-type backlight module for a liquid crystal display (LCD). In some conditions, it is required to have an optical lens which can help the light emitted from a light emitting diode to have a wider illuminating angle. However, part of the light enters into the optical lens in a large angle relative to an optical axis of the light emitting diode, and leaves from the optical lens uselessly.

What is needed, therefore, is an improved optical lens and a light source module having the optical lens to overcome the above described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments of an optical lens and a light source module will now be described in detail below and with reference to the drawings.

Figure 1:
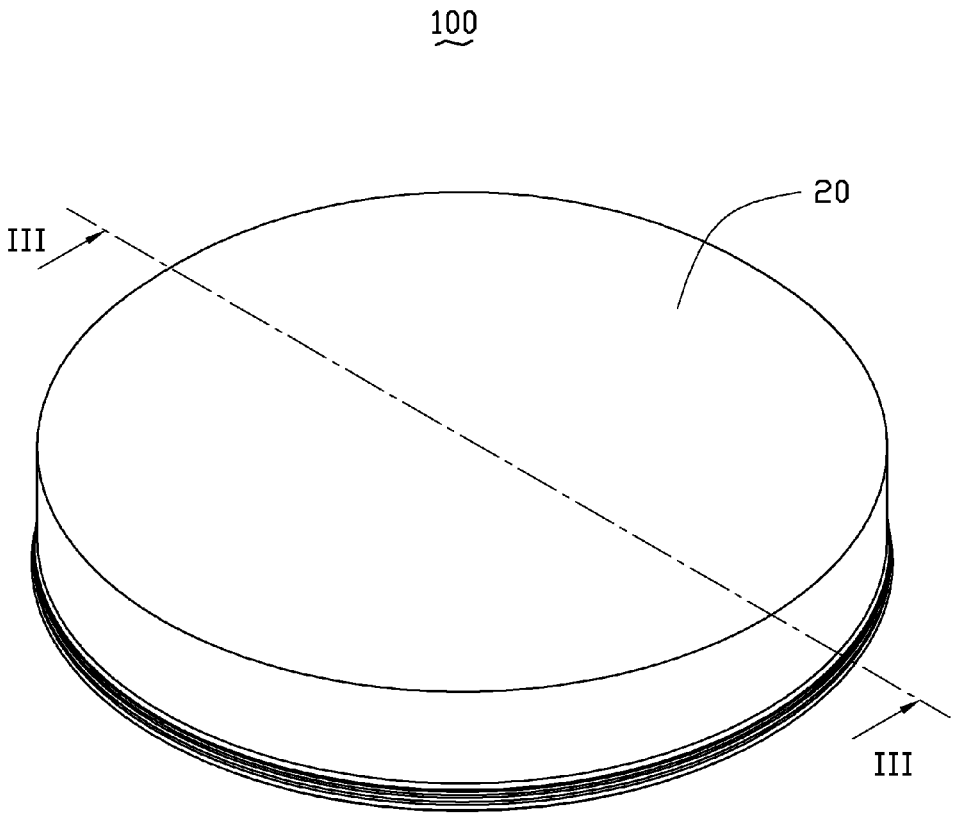
FIG. 1 is an isometric view of a light source module having an optical lens in accordance with an exemplary embodiment of the present disclosure.
Figure 2:
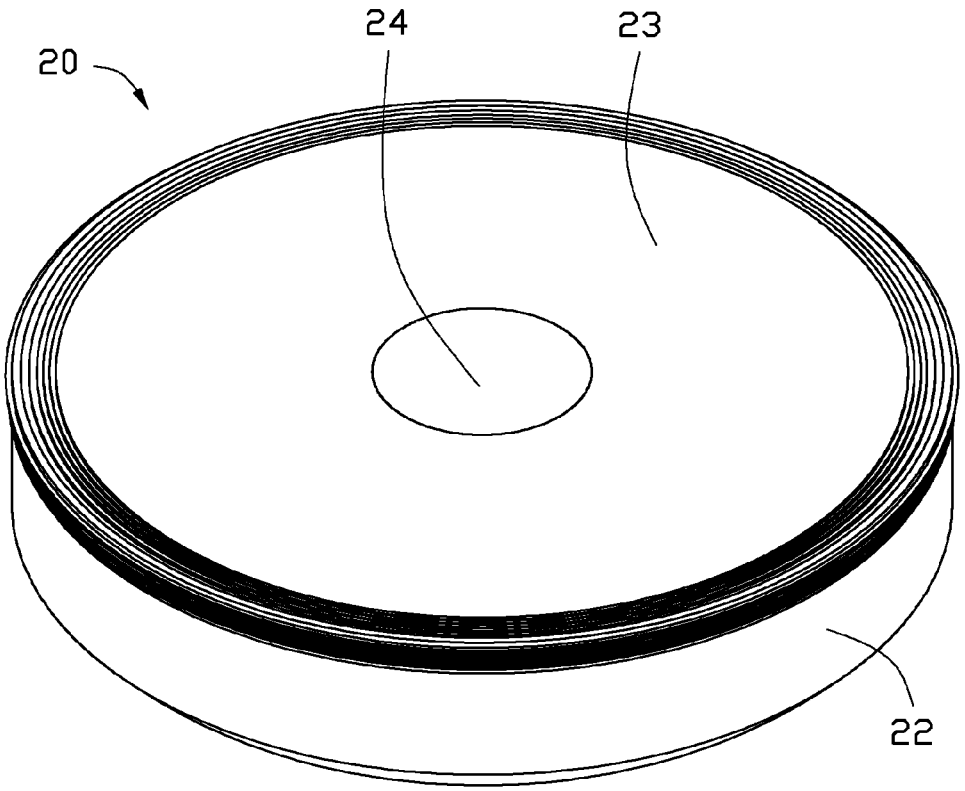
FIG. 2 is an inverted view of the optical lens of the light source module in FIG. 1.
Figure 3:
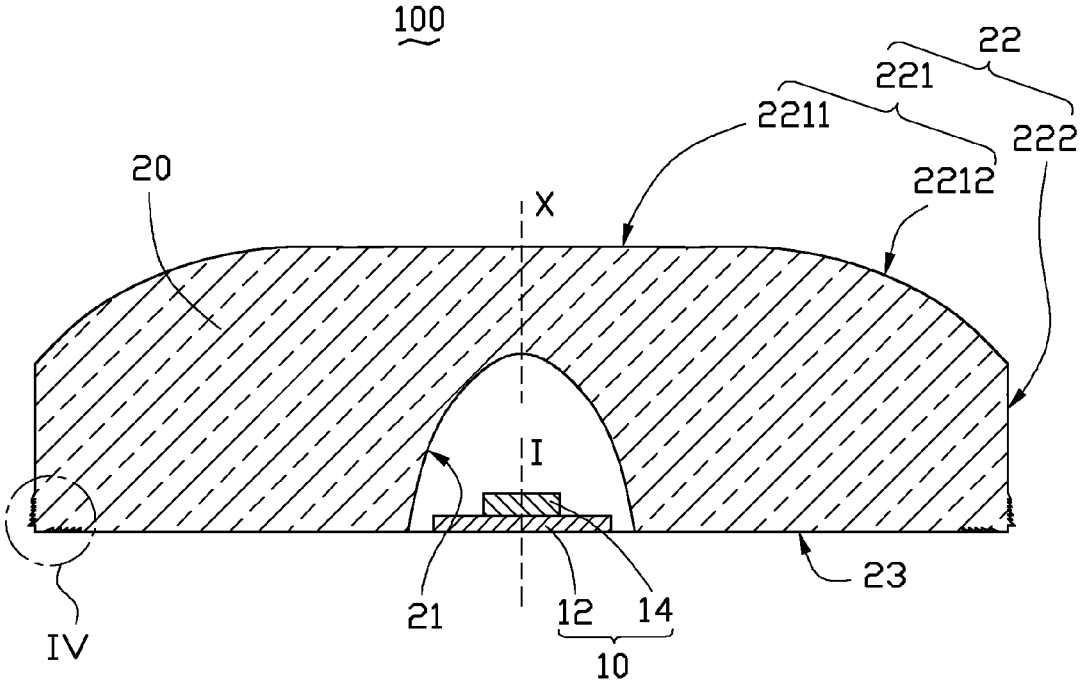
FIG. 3 is a cross section view of the light source module in FIG. 1, taken along a line III-III thereof.
Figure 4:
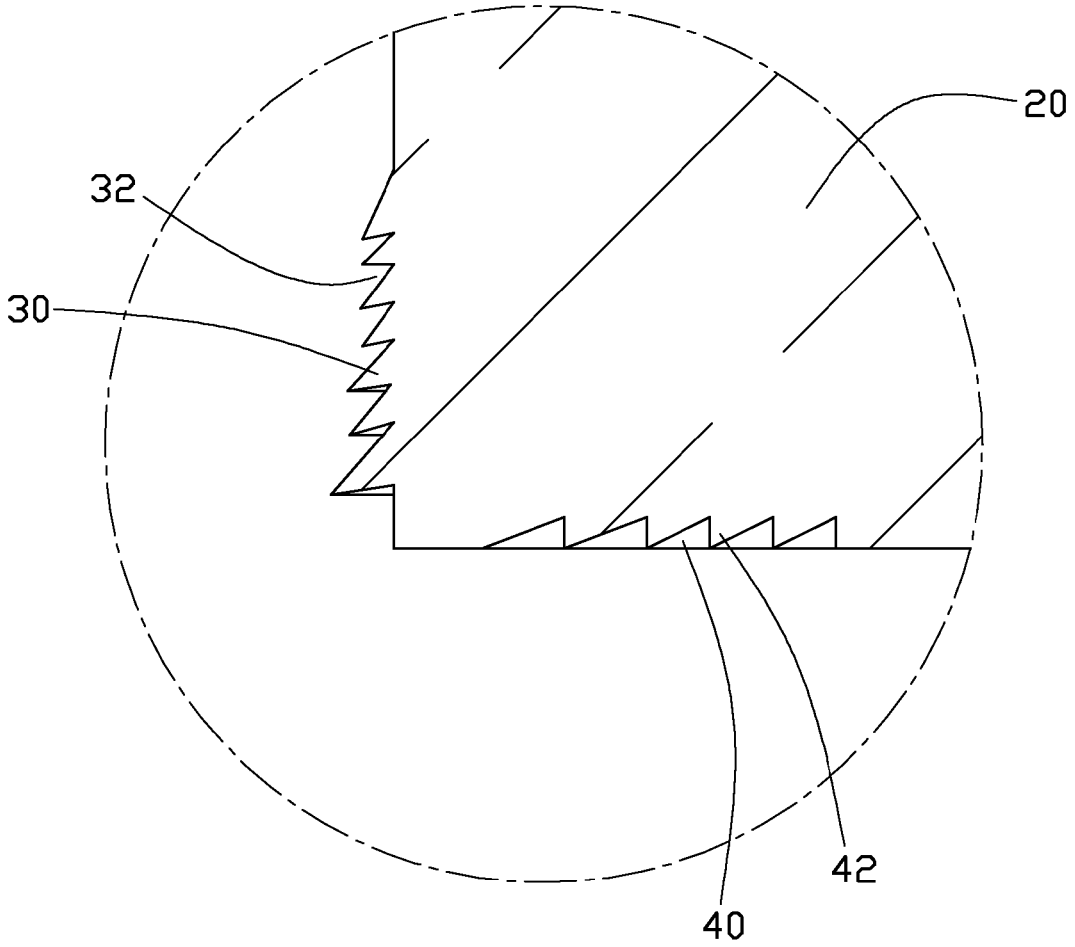
FIG. 4 is an enlarged view of part IV in FIG. 3.

Referring to FIGS. 1 through 4, a light source module 100 in accordance with an exemplary embodiment of the disclosure is illustrated. The light source module 100 includes a light source 10 and an optical lens 20 covering the light source 10.

The optical lens 20 includes a light incident face 21 facing the light source 10, a light emitting face 22 opposite to the light incident face 21, and a connecting face 23 connecting the light incident face 21 and the light emitting face 22. The light source 10 has an optical axis I, around which light emitted from the light source 10 concentrates in a surrounding space.

In this embodiment of the present disclosure, the light source 10 is a light emitting diode (LED), and includes a supporting base 12 and an LED chip 14 mounted on the supporting base 12. The supporting base 12 is flat. The supporting base 12 may be made of electrically-insulating materials such as epoxy, silicon or ceramic. The LED chip 14 may be made of semiconductor materials such as GaN, InGaN, AlInGaN or the like. Preferably, the LED chip 14 emits visible light when being activated.

The optical lens 20 is integrally made of transparent materials such as PC (polycarbonate), PMMA (polymethyl methacrylate) or optical glass. It could be understood, a plurality of fluorescence, such as YAG, TAG, silicate, nitride, nitrogen oxides, phosphide, arsenide, telluride or sulfide, could be further provided to mix in the optical lens 20.

The optical lens 20 is located above and spaced from the light source 10. A center of a bottom face of the optical lens 20 is recessed inwardly, whereby the light incident face 21 and a receiving space 24 for accommodating the light source 10 are formed. The connecting face 23 is an annular and planar face surrounding the light incident face 21. In use, the connecting face 23 is fitly attached on a supporting face (not shown) supporting the light source 10 and the optical lens 20. The optical lens 20 defines a central axis X, and the optical lens 20 is rotationally symmetrical relative to the central axis X. The central axis X of the optical lens 20 is aligned with the optical axis I of the light source 10. The light incident face 21 is a curved face and protrudes away from the light source 10. The light incident face 21 is a sculptured face, an ellipsoidal face, a spherical face or a paraboloidal face. The light incident face 21 is rotationally symmetrical relative to the central axis X. The light emitting face 22 is rotationally symmetrical relative to the central axis X.

The light emitting face 22 includes a lateral face 222 extending upwardly from an outer periphery of the connecting face 23 and a top face 221 located above the light incident face 21. The lateral face 222 is a cylindrical face. The top face 221 of the light emitting face 22 includes a center facet 2211 and a curved facet 2212 surrounding and extending outwardly from the center facet 2211. The center facet 2211 is planar. The center facet 2211 is rotationally symmetrical relative to the central axis X. The curved facet 2212 protrudes away from the light incident face 21. The curved facet 2212 is sculptured, ellipsoidal, spherical or paraboloidal. The curved facet 2212 is rotationally symmetrical relative to the central axis X. An outer periphery of the curved facet 2212 of the light emitting face 22 correspondingly meets the lateral face 222.

The optical lens 20 further includes a plurality of first protrusions 30 protruding outwardly from the lateral face 222. The first protrusions 30 are annular and extend along a circumferential direction of the lateral face 222. One first protrusion 30 abuts another first protrusion 30. A first groove 32 is formed between every two neighbouring first protrusions 30. A cross section of each of the first protrusions 30 is triangular. A cross section of the first protrusions 30 is in a zigzag pattern. The first protrusions 30 are located adjacent to the connecting face 23.

The optical lens 20 further includes a plurality of second grooves 40 defined in the connecting face 23. The second grooves 40 are annular, and concentric relative to a center of the connecting face 23. A second protrusion 42 is formed between every two neighbouring second grooves 40. A cross section of each of the second protrusions 42 is triangular. A cross section of the second protrusions 42 is in a zigzag pattern. The second protrusions 42 are located adjacent to the lateral face 222. One second protrusion 42 abuts another second protrusion 42.

In use, the light emitted from the light source 10 is entered into the optical lens 20 through the light incident face 21 and refracted, then transmitted in the optical lens 20, and exited and refracted from the center facet 2211 and the curved facet 2212 of the top face 221, and the lateral face 222. Part of the light meets the first protrusions 30 and the second protrusions 42 may occur TIR (total internal reflection) and be reflected toward the light emitting face 22, thus avoiding wasting, and such that a light intensity of the light source module 100 increases to a certain extent.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An optical lens for adjusting light emitted from a light source, comprising:

a light incident face facing the light source;

a light emitting face opposite to the light incident face;

a connecting face connecting the light incident face and the light emitting face; and a plurality of first protrusions protruding outwardly from the light emitting face, a top end of the first protrusions being lower than a top end of the light incident face;

wherein the connecting face is planar, and the light emitting face comprises a lateral face extending upwardly from an outer periphery of the connecting face and a top face located above the light incident face, the top face comprising a planar center facet and a curved facet, the curved facet surrounding and extending outwardly from the center facet; and wherein the first protrusions are formed on the lateral face and located adjacent to the connecting face.

2. The optical lens as claimed in claim 1, wherein the first protrusions are annular and extend along a circumferential direction of the lateral face.

3. The optical lens as claimed in claim 1, wherein a cross section of the first protrusions is in a zigzag pattern.

4. The optical lens as claimed in claim 1, wherein one first protrusion abuts another first protrusion.

5. The optical lens as claimed in claim 4, wherein a first groove is formed between every two neighbouring first protrusions.

6. The optical lens as claimed in claim 1, further comprises a plurality of second grooves defined in the connecting face.

7. The optical lens as claimed in claim 6, wherein the second grooves are annular, and concentric relative to a center of the connecting face, and a second protrusion is formed between every two neighbouring second grooves.

8. The optical lens as claimed in claim 7, wherein a cross section of the second protrusions is in a zigzag pattern.

9. The optical lens as claimed in claim 6, wherein the second grooves are located adjacent to the lateral face.

10. An optical lens for adjusting light emitted from a light source, comprising:

a light incident face facing the light source;

a light emitting face opposite to the light incident face;

a connecting face connecting the light incident face and the light emitting face; and a plurality of first protrusions protruding outwardly from the light emitting face, a top end of the first protrusions being lower than a top end of the light incident face;

a plurality of first grooves defined in the connecting face, wherein the connecting face is planar, and the light emitting face comprises a lateral face extending upwardly from an outer periphery of the connecting face and a top face located above the light incident face, the top face comprising a planar center facet and a curved facet, the curved facet surrounding and extending outwardly from the center facet; and wherein the first grooves are located adjacent to the lateral face.

11. The optical lens as claimed in claim 10, wherein the first grooves are annular, and concentric relative to a center of the connecting face, and a first protrusion is formed between every two neighbouring second grooves.

12. The optical lens as claimed in claim 11, wherein a cross section of the first protrusions is in a zigzag pattern.

13. The optical lens as claimed in claim 10, further comprises a plurality of second protrusions protruding outwardly from the light emitting face.

14. The optical lens as claimed in claim 13, wherein the second protrusions are annular and extend along a circumferential direction of the lateral face.

15. The optical lens as claimed in claim 13, wherein a cross section of the second protrusions is in a zigzag pattern.

16. The optical lens as claimed in claim 13, wherein one second protrusion abuts another second protrusion.

17. The optical lens as claimed in claim 16, wherein a second groove is formed between every two neighbouring second protrusions.

18. A light source module, comprising:

a light source;

an optical lens covering the light source, and the optical lens comprising:

a light incident face facing the light source;

a light emitting face opposite to the light incident face; and a connecting face connecting the light incident face and the light emitting face;

a plurality of protrusions protruding outwardly from the light emitting face, a top end of the protrusions being lower than a top end of the light incident face; and a plurality of grooves defined in the connecting face;

wherein the connecting face is planar, and the light emitting face comprises a lateral face extending upwardly from an outer periphery of the connecting face and a top face located above the light incident face, the top face comprising a planar center facet and a curved facet, the curved facet surrounding and extending outwardly from the center facet; and wherein the protrusions are formed on the lateral face and located adjacent to the connecting face, and the grooves are located adjacent to the lateral face.

19. The light source module as claimed in claim 18, wherein the protrusions are annular and extend along a circumferential direction of the lateral face, and a cross section of the protrusions is in a zigzag pattern.

20. The light source module as claimed in claim 18, wherein the grooves are annular, and concentric relative to a center of the connecting face.

* * * * *